US009939167B2

(12) United States Patent
Hoppe et al.

(10) Patent No.: US 9,939,167 B2
(45) Date of Patent: Apr. 10, 2018

(54) HVAC CONTROLLER

(71) Applicant: Honeywell International Inc., Morristown, NJ (US)

(72) Inventors: Michael Hoppe, Minnetonka, MN (US); Daniel Murr, Mounds View, MN (US); Patrick Hudson, Elk River, MN (US)

(73) Assignee: Honeywell International Inc., Morris Plains, NJ (US)

( * ) Notice: Subject to any disclaimer, the term of this patent is extended or adjusted under 35 U.S.C. 154(b) by 557 days.

(21) Appl. No.: 14/521,276

(22) Filed: Oct. 22, 2014

(65) Prior Publication Data

US 2016/0116182 A1 Apr. 28, 2016

(51) Int. Cl.
*F24F 11/00* (2006.01)

(52) U.S. Cl.
CPC ..... *F24F 11/0086* (2013.01); *F24F 11/0034* (2013.01); *F24F 2011/0035* (2013.01); *F24F 2011/0091* (2013.01)

(58) Field of Classification Search
CPC ..... F24F 11/0086; F24F 11/0034; F24F 2011/0091; F24F 2011/0035
See application file for complete search history.

(56) References Cited

U.S. PATENT DOCUMENTS

| | | | | |
|---|---|---|---|---|
| 5,686,942 | A * | 11/1997 | Ball | G06F 3/0421 345/158 |
| 7,203,911 | B2 * | 4/2007 | Williams | G06F 3/011 345/158 |
| 7,455,336 | B2 | 11/2008 | Kates | |
| 8,305,514 | B2 | 11/2012 | Shinn et al. | |
| 9,160,923 | B1 * | 10/2015 | Polansky | G06F 1/1686 |
| 2011/0006892 | A1 | 1/2011 | Karpinsky | |
| 2012/0179300 | A1 * | 7/2012 | Warren | F24F 11/0012 700/278 |
| 2012/0307423 | A1 | 12/2012 | Bohn et al. | |
| 2013/0127748 | A1 | 5/2013 | Vertegaal et al. | |

OTHER PUBLICATIONS

Crawford, Gregory, "Flexible Flat Panel Display Technology", 2005 John Wiley & Sons, Ltd.*

(Continued)

*Primary Examiner* — Carlos Ortiz Rodriguez
(74) *Attorney, Agent, or Firm* — Seager, Tufte & Wickhem, LLP

(57) ABSTRACT

A user interface for an HVAC controller includes an electronic display and a proximity sensor for sensing a position of a user relative to the electronic display. A display controller is operably coupled to the electronic display and the proximity sensor and is configured to display one or more display elements on the electronic display. In some embodiments, a location of one or more of the display elements on the electronic display may be based, at least in part, on the position of the user sensed by the proximity sensor. In some embodiments, a size of one or more of the display elements on the electronic display may be based, at least in part, on the position of the user sensed by the proximity sensor.

18 Claims, 16 Drawing Sheets

(56) References Cited

OTHER PUBLICATIONS

Dolcourt, "What it Really Takes to Make a Flexible Phone (Smartphones Unlocked)," Downloaded from http://www.cnet.com/8301-17918_1-57567014-85/what-it-really-takes-to-make-a-flexible . . . , 6 pages, Feb. 1, 2013.
Fujikake, "Advanced Flexible Liquid-Crystal Display Technologies," SPIE, 10.1117/2.1200811.1376, 3 pages, 2008.
getandroidstuff.com/samsung-flexible-transparent-amoled-display-showed-fpd-2010/, "Samsung Flexible and Transparent AMOLED Display Showed in FPD," 5 pages, Oct. 7, 2013.
http://madsbusk.dk/, "Danfoss FIT Climate Controller for 2019—A Futuristic Climate Controller for Your Home," 3 pages, downloaded, Jan. 27, 2014.
Jensen, "Danfoss Fit—A Climate Controller for Year 2019," Downloaded from http://www.behance.net/gallery/Danfoss-Fit/1285023, 6 pages, Jan. 27, 2014.
Liszewski, "[CES 2010] Concept Laptop With Transparent AMOLED Display," Downloaded from www.ohgizmo.com/2010/01/07/ces-2010-laptop-with-transparent-amoled-display/, 2 pages, printed Oct. 7, 2013.
Nguyen, "AMOLED Displays Now Performing Better in Direct Sunlight," Pocketnow, 3 pages, Dec. 28, 2009.
Varias, "Samsung Super Thin AMOLED Display Makes Look Forward to a Screen-Filled Future," downloaded from http://technabob.com/blog/2011/01/09/samsung-thin-flexible-amoled-display/, 6 pages, printed Oct. 7, 2013.

* cited by examiner

HVAC CONTROLLER

BACKGROUND

Building controllers are often used to control building systems such as building security, building automation and building heating, ventilation, and/or air conditioning (HVAC) systems. As an example, HVAC systems typically include an HVAC controller that controls various HVAC components of the HVAC system in order to affect and/or control one or more environmental conditions within the building. Improvements in the hardware, the user experience, and the functionality of such systems are desirable.

SUMMARY

This disclosure relates to methods and apparatus for controlling a building system. The disclosure also relates to improvements in hardware, user experience, and functionality of a building controller such as an HVAC controller.

In an illustrative but non-limiting example, the disclosure describes a user interface for a building controller. In some embodiments, the building controller may be an HVAC controller. The user interface includes an electronic display and a proximity sensor for sensing a position of a user relative to the electronic display. A display controller is operably coupled to the electronic display and the proximity sensor and is configured to display one or more display elements on the electronic display. In some embodiments, a location of one or more of the display elements on the electronic display may be based, at least in part, on the position of the user sensed by the proximity sensor. In some embodiments, a size of one or more of the display elements on the electronic display may be based, at least in part, on the position of the user sensed by the proximity sensor.

In another illustrative but non-limiting example, the disclosure describes a user interface for a building controller that in some instances, may be an HVAC controller. The user interface includes a flexible electronic display and a control module that is operably coupled to the flexible electronic display and that is configured to display one or more display elements of a graphical user interface on the flexible electronic display. The control module is operatively connected to the flexible electronic display and is configured to hold a portion of the flexible electronic display immediately adjacent the control module in a first profile. The flexible electronic display transitions to a second profile away from the control module, wherein the second profile is different from the first profile.

In another illustrative but non-limiting example, the disclosure describes a user interface assembly for an HVAC controller. The user interface assembly includes a flexible electronic display and a display controller that is operably coupled to the flexible electronic display. The display controller is configured to display one or more display elements on the electronic display. The user interface assembly is configured to be flexed to assume a shape of a curved surface in the field, and then mounted to the curved surface.

In another illustrative but non-limiting example, the disclosure describes a method for installing an HVAC control device. The HVAC control device may be flexed to a desired shape in the field and then mounted to a mounting surface such that the HVAC control device maintains the desired shape after being mounted.

In another illustrative but non-limiting example, the disclosure describes a user interface for an HVAC controller having a viewing side and a mounting side. The user interface includes a color electronic display and a display controller that is operatively coupled to the color electronic display and is positioned behind the color electronic display toward the mounting side of the user interface. A color sensor operatively coupled to the display controller faces the mounting side of the user interface for sensing a color. The display controller is configured to display a background color on the color electronic display and one or more display elements and is configured to change the background color displayed on the color electronic display to match or substantially matches the color sensed by the color sensor.

The preceding summary is provided to facilitate an understanding of some of the innovative features unique to the present disclosure and is not intended to be a full description. A full appreciation of the disclosure can be gained by taking the entire specification, claims, drawings, and abstract as a whole.

BRIEF DESCRIPTION OF DRAWINGS

The disclosure may be more completely understood in consideration of the following detailed description in connection with the accompanying drawings, in which.

Figure 1:
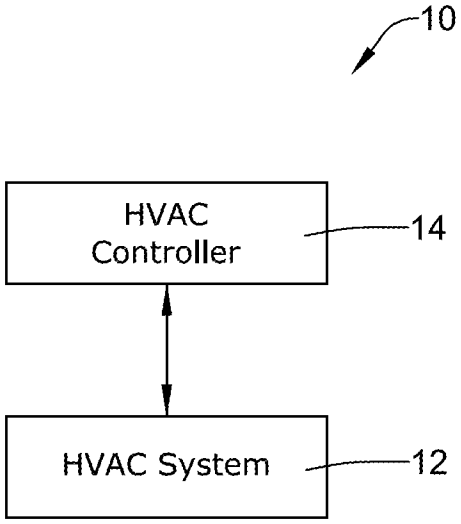
FIG. 1 is a schematic block diagram of an illustrative system including an HVAC system and a HVAC controller.

While the disclosure is amenable to various modifications and alternative forms, specifics thereof have been shown by way of example in the drawings and will be described in detail. It should be understood, however, that the intention is not to limit the disclosure to the particular embodiments described. On the contrary, the intention is to cover all modifications, equivalents, and alternatives falling within the spirit and scope of the disclosure.

DESCRIPTION

The following description should be read with reference to the drawings wherein like reference numerals indicate like elements within a group of figures having the same figure number. Like reference numeral will not necessarily indicate like elements across different figure numbers. The drawings, which are not necessarily to scale, are not intended to limit the scope of the disclosure. In some of the figures, elements not believed necessary to an understanding of relationships among illustrated components may have been omitted for clarity.

All numbers are herein assumed to be modified by the term "about." The recitation of numerical ranges by endpoints includes all numbers subsumed within that range (e.g., 1 to 5 includes 1, 1.5, 2, 2.75, 3, 3.80, 4, and 5).

As used in this specification and the appended claims, the singular forms "a", "an", and "the" include the plural referents unless the content clearly dictates otherwise. As used in this specification and the appended claims, the term "or" is generally employed in its sense including "and/or" unless the content clearly dictates otherwise.

It is noted that references in the specification to "an embodiment", "some embodiments", "other embodiments", "an illustrative embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is contemplated that the feature, structure, or characteristic may be applied to other embodiments whether or not explicitly described unless clearly stated to the contrary.

Within this disclosure, the terms "thermostat", "programmable thermostat", "WiFi enabled thermostat", "HVAC controller", and "device" may refer to an HVAC controller when the context makes clear that reference to the thermostat as a whole is intended. Although reference is made to a programmable thermostat in portions of the description that follows, it should be appreciated that each of those descriptions may apply to a programmable thermostat which may be expressly WiFi enabled even when the feature or features described do not expressly mention or require a communication link such as a WiFi connection. It will also be appreciated that reference herein to an HVAC controller is illustrative only, as a building controller may also be a building security controller or a building automation system controller, instead of (or in addition to) being an HVAC controller.

FIG. 1 is a schematic illustration of a system 10 that includes an HVAC system 12 and an HVAC controller 14. It will be appreciated that the HVAC system 12 may include a variety of different HVAC equipment such as heating equipment, cooling equipment and ventilation equipment. Illustrative but non-limiting examples of such equipment include furnaces, boilers, heat pumps, air conditioners, ventilation fans, air exchangers, humidifiers and dehumidifiers and the like. The HVAC controller 14 may be configured to monitor conditions within a building and send control signals to the HVAC system 12 in order to regulate air temperature and other conditions within the building. The HVAC controller 14 may represent a single controller, or may include two or more distinct controllers that may be centrally located or spaced apart within the building. An illustrative but non-limiting example of spaced apart controllers is a centrally located zone controller that is operatively coupled to a plurality of zone thermostats located in each zone. In some embodiments, the HVAC controller 14 may be a programmable or non-programmable thermostat.

Figure 2:
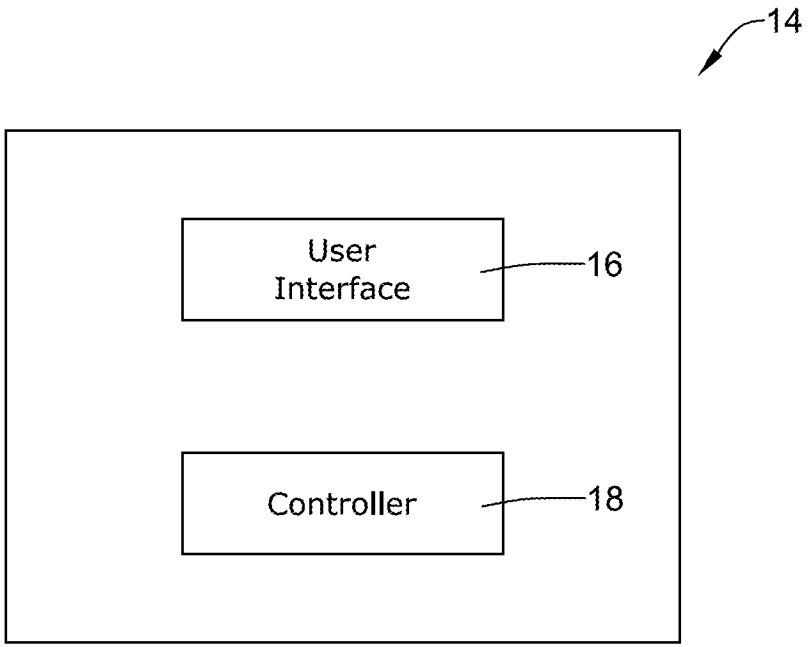
FIG. 2 is a schematic block diagram of the HVAC controller of FIG. 1.

FIG. 2 shows that an illustrative HVAC controller 14 that includes a user interface 16 and a controller 18. The user interface 16 may be configured to display information for the user as well as to solicit and obtain information from the user. In some embodiments, the controller 18 may be configured to operate in accordance with an algorithm that regulates operation of the HVAC controller 14 and thus controls or at least partially controls one or more components of the HVAC system 12.

The HVAC controller 14 may, for example, operate in accordance with a control algorithm that provides temperature set point changes, humidity set point changes, schedule changes, start and end time changes, window frost protection setting changes, operating mode changes, and/or the like. At least a portion of the control algorithm may be stored locally in the memory of the HVAC controller 14 and, in some cases, may be received from an external web service. The control algorithm (or portion thereof) stored locally in the memory of the HVAC controller 14 may in some cases be periodically updated in accordance with a predetermined schedule (e.g. once every 24 hours, 48 hours, 72 hours, weekly, monthly, etc.), updated in response to any changes to the control algorithm (e.g. set point change) made by a user, and/or updated in response to a user's request. The updates to the control algorithm or portion of the control algorithm (e.g. set points, schedules, etc.) stored in the memory may be received from an external web service. In some cases, the control algorithm may include settings such as set points. In some cases, at least part of the control algorithm may be stored and executed remotely, such as at an external web service.

In some cases, the HVAC controller 14 may operate according to a first operating mode having a first temperature set point, a second operating mode having a second temperature set point, a third operating mode having a third temperature set point, and/or the like. In some cases, the first operating mode may correspond to an occupied mode and the second operating mode may correspond to an unoccupied mode. In some cases, the third operating mode may correspond to a holiday or vacation mode wherein the building or structure in which the HVAC system is located is expected to be unoccupied for an extended period of time. In other cases, the third operating mode may correspond to a sleep mode wherein the building occupants are either asleep or inactive for a period of time. These are just some examples. It will be understood that the HVAC controller 14 may be capable of operating in additional modes as necessary or desired. The number of operating modes and the operating parameter settings associated with each of the operating modes may be established locally through the user interface 16, through a remote user device (e.g. user's cell phone) and/or through an external web service and delivered to the HVAC controller 14 where they may be stored in memory.

In some cases, the HVAC controller 14 may operate according to one or more predetermined operating parameter settings associated with a user profile for an individual user. The user profile may be stored in the memory of the HVAC controller 14 and/or may be hosted by an external web service and stored on an external web server. The user profile may include one or more user-selected settings for one or more operating modes that may be designated by the user. For example, the HVAC controller 14 may operate according to a first operating mode having a first temperature set point associated with a first user profile, a second operating mode having a second temperature set point associated with the first user profile, a third operating mode having a third temperature set point associated with the first user profile, and/or the like. In some cases, the first operating mode may correspond to an occupied mode, the second operating mode may correspond to an unoccupied mode, and the third operating mode may correspond to a vacation or extended away mode wherein the building or structure in which the HVAC system 12 is located may be unoccupied for an extended period of time. In some cases, multiple user profiles may be associated with the HVAC controller 14.

In some cases, the HVAC controller 14 may be programmed to execute a guided set-up routine that may guide a user through configuring the HVAC controller 14 to control one or more HVAC components of their particular HVAC system. In some cases, the user may have limited knowledge about the particular HVAC system configuration. The guided set-up routine may be configured to guide a user through set-up of the HVAC controller 14 without requiring detailed knowledge of the particular HVAC system and/or without requiring the user to consult a technical manual or guide. Further details pertaining to the programming and use of the illustrative HVAC controller 14 may be found in U.S. Provisional Application Ser. No. 61/914,877, filed Dec. 11, 2013, which is incorporated herein by reference in its entirety.

While the HVAC controller 14 is described with respect to a particular embodiment of HVAC controller 14, it will be appreciated that this description is illustrative only, as an HVAC controller 14 may take a variety of different physical shapes and configurations, and can include or exclude any variety of programming features.

The user interface 16 may provide a user of the HVAC controller 14 with information pertaining to the status, operation and/or programming of the HVAC system. The user interface 16 may include one or more displays that are configured to provide information to the user. The user interface 16 may also include, for example, one or more touch screens, buttons, switches and/or knobs that enable a user to provide input to the HVAC controller 14. This sometimes includes HVAC programming information as described above. The user interface 16 can include any particular hardware or software that enables information to be displayed to the user and/or solicited or received from the user.

Figure 3:
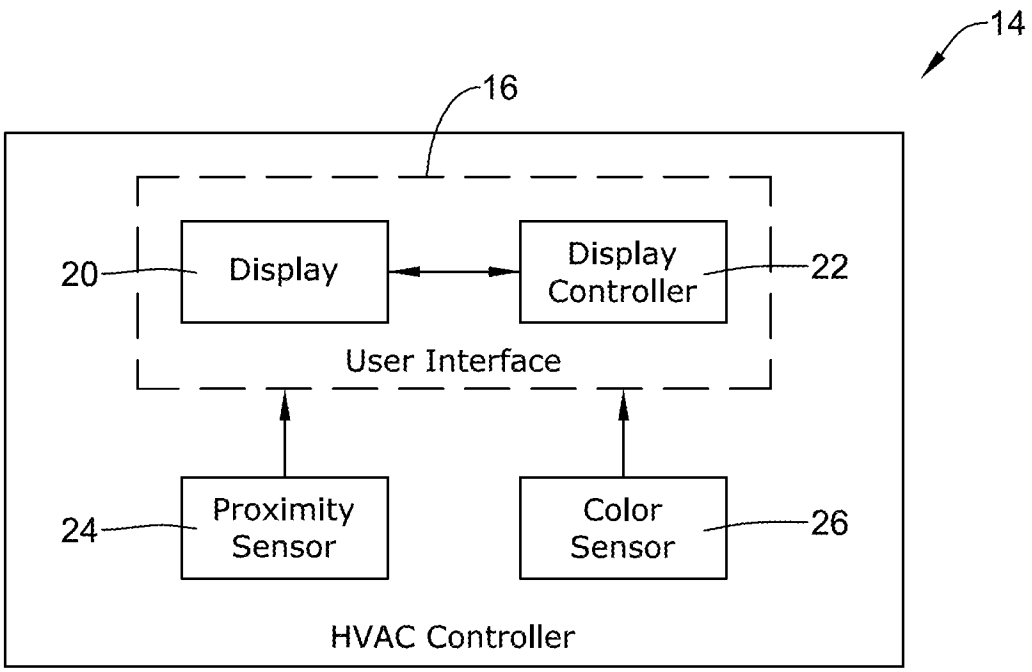
FIG. 3 is a schematic block diagram of the HVAC controller of FIG. 2.

FIG. 3 provides additional information describing the illustrative HVAC controller 14. As illustrated, the user interface 16 may be seen as including a display 20 and a display controller 22 that is operably coupled with the display 20 such that the display controller 22 may control the content and/or appearance of information displayed on the display 20. In some embodiments, for example, the display 20 may display one or more pieces of information pertaining to the operation of the HVAC system 12. Illustrative but non-limiting examples include current sensed temperatures, temperature set points, programming information and the like. In some embodiments, the display 20 includes a touch screen that can not only display information but can also solicit and receive information.

In some embodiments, as illustrated, the HVAC controller 14 may include a proximity sensor 24. If present, the proximity sensor 24 may be configured to determine, for example, when a user is approaching the HVAC controller 14, and to wake up the HVAC controller 14 and/or the user interface 16 of the HVAC controller 14 before the individual reaches the HVAC controller 14. As a result, when the user reaches the HVAC controller 14, the HVAC controller 14 is already awake and ready to display and/or solicit information from the user. In some embodiments, as will be discussed with respect to subsequent Figures, the proximity sensor 24 may be configured to determine if the user is approaching from the left or the right, for example. In some embodiments, the proximity sensor 24 may be configured to determine if the user is relatively tall or relatively short (or in a wheelchair, for example).

The proximity sensor 24 is shown operably coupled with the user interface 16 such that the display controller 22 may alter how information is displayed on the display 20 based at least in part on input from the proximity sensor 24. For example, if the proximity sensor 24 determines that a user is relatively tall, the display controller 22 may instruct the display 20 to display at least certain information at a relatively higher position on the display 20. Conversely, if the proximity sensor 24 determines that the user is relatively short, such as a child or someone in a wheelchair, the display controller 22 may instruct the display 20 to display at least certain information at a relatively lower position on the display 20. In some embodiments, if the proximity sensor 24 determines that the user is off to a side (either left side or right side) of the HVAC controller 14, the display controller 22 may instruct the display 20 to display at least certain information at a lateral position that is relatively closer to the user. For example, move information to the left side if the user is on the left side, and move information to the right side if the user is on the right side.

In some instances, the proximity sensor 24 can be configured to detect the presence of a person near the HVAC controller 14. In some cases, the proximity sensor 24 may operate by detecting any desired or useful energy band within the electromagnetic spectrum. An energy band may be considered as referring to energy within a particular frequency or wavelength range. In some embodiments, the proximity sensor 24 may be sensitive to the infrared (IR) portion of the electromagnetic spectrum and thus may be considered as being an IR proximity sensor. In some embodiments, the proximity sensor 24 may be a CCD or other imaging sensor.

In some embodiments, the proximity sensor 24 may be a passive infrared sensor (PIR). In some cases, the sensor may detect thermal radiation of human body (e.g. wavelength of 5-15 micrometers—infrared [IR] band), and convert it to a change of crystal capacitance, a pulse, and/or some other electrical signal that is indicative of the magnitude of detected IR radiation. In some cases, the proximity sensor 24 may include two separate detectors on a sensor die, each laterally spaced from the other. Having two spaced sensors may help detect lateral motion across the field of view of the proximity sensor 24. While IR sensors are disclosed here as one example, it is contemplated that any suitable sensor may be used, as desired.

In some embodiments, the HVAC controller 14 may utilize wireless technology in detecting the presence and/or motion of an individual relative to the HVAC controller 14. For example, if an individual is wearing a wireless-enabled device, the HVAC controller 14 may include two or more spaced apart radios that are in communication with the wireless-enabled device. In another example, the proximity sensor 24 may include radar, in which electromagnetic waves are emitted and then the timing of their return can be analyzed to determine if something is moving towards or away from the HVAC controller 14.

In some instances, the HVAC controller 14 may wake up in response to detecting an individual moving towards the HVAC controller 14. In some cases, waking up the HVAC controller 14 includes energizing a display screen so that the approaching individual can read information displayed on the display screen without having to first interact with the HVAC controller 14. In some instances, the HVAC controller 14 may be configured to wake up when the individual is within a threshold distance of 4 feet (or less) from the HVAC controller 14. In some cases, the threshold distance may be a programmable parameter.

With reference once again to FIG. 3, in some embodiments the HVAC controller 14 may include a color sensor 26. In some embodiments, the HVAC controller 14 may include a viewing, or front side, and an opposing mounting, or back side. The color sensor 26, which may take any desired form, such as a digital camera pixel or pixels, may face the mounting side of the HVAC controller 14 such that the color sensor 26 may detect a color of a surrounding environment. For example, in some cases the color sensor 26 may detect a color of a wall to which the HVAC controller 14 is mounted. The color sensor 26 is operably coupled to the user interface such that the display controller 22 can instruct the display 20, or at least a portion of the display 20, to alter its background color to emulate the detected wall color. As a result, the HVAC controller 14 may be less noticeable on the wall. In some embodiments, the display 20 may instead display a background color that is complementary to the detected wall color, or is perhaps an attractive accent color relative to the detected wall color.

Figure 4:
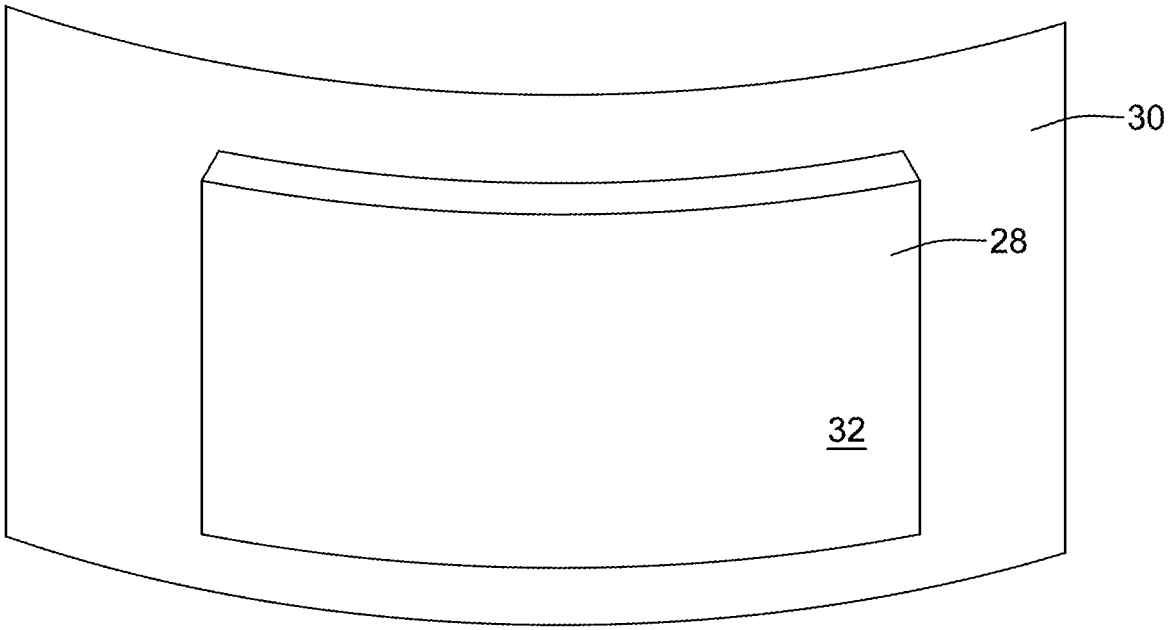
FIG. 4 is a schematic illustration of an illustrative HVAC controller mounted on a curved surface.

In some embodiments, the HVAC controller 14 or at least a portion thereof may be configured to be mounted to a curved surface. FIG. 4 illustrates an HVAC controller 28 that is mounted to a curved surface 30. The curved surface 30 may, for example, be the side of a support pillar or other decorative feature within a building. In some embodiments, the curved surface 30 may be a curved drywall or plaster surface within a building. The HVAC controller 28, which may include the features and elements described with respect to the HVAC controller 14, may include additional components such as an electronics bezel, not shown in FIG. 4.

Figure 5:
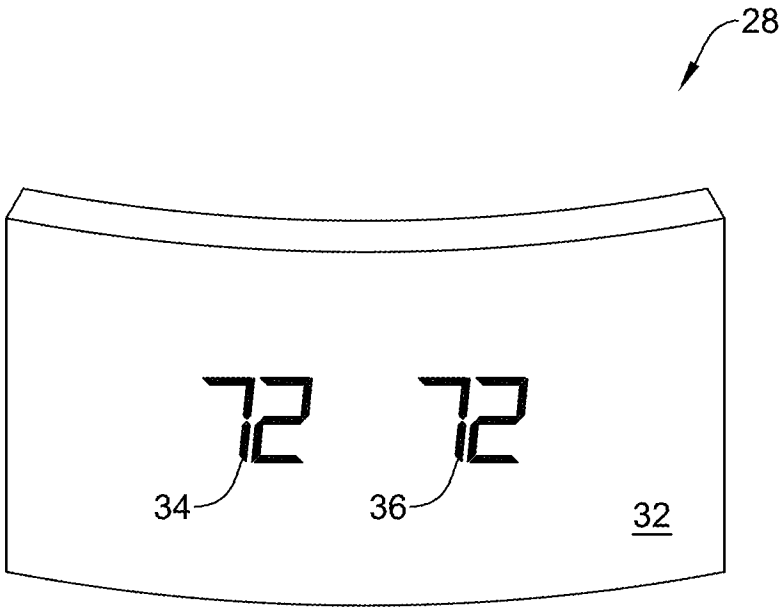
FIG. 5 is an illustration of a screen displayable on the HVAC controller of FIG. 4.
Figure 6:
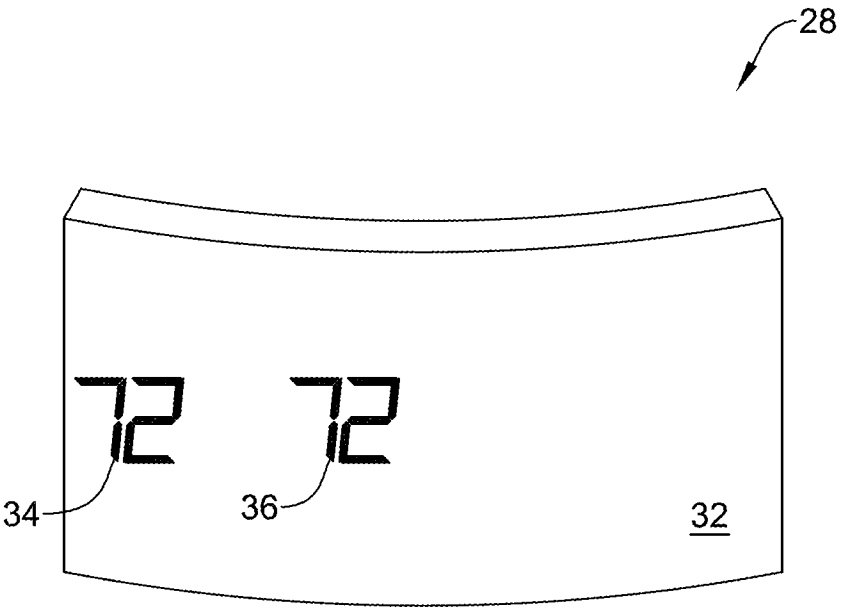
FIG. 6 is an illustration of a screen displayable on the HVAC controller of FIG. 4.
Figure 7:
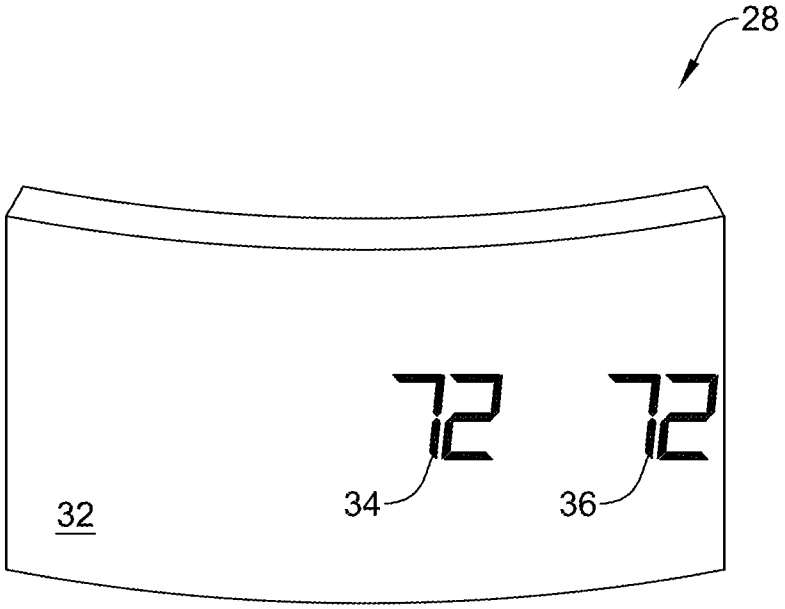
FIG. 7 is an illustration of a screen displayable on the HVAC controller of FIG. 4.

The HVAC controller 28 may include a flexible display 32, such as a flexible LED display or a flexible LCD display. In some embodiments, the flexible display 32 may include or is otherwise formed from a flexible AMOLED (active-matrix organic light emitting diode) display. In some cases, the flexible display 32 is transparent (except for the displayed information). In some embodiments, the flexible display 32 functions as a touch screen electronic display. It will be appreciated that the flexible display 32 may be configure to display any variety of information, including but not limited to scheduling information, equipment status, operating mode (HEAT, COOL, OFF), fan status (ON, OFF, AUTO), current temperature, temperature set points, other ambient conditions, and the like. FIGS. 5 through 7 provide illustrative examples of how the display controller 22 may alter the information displayed on the flexible display 32, depending on the user position relative to the flexible display 32 as detected by the proximity sensor 24. For illustration purposes, FIGS. 5 through 7 illustrate a sensed temperature value 34 and a temperature set point value 36, both of which are shown as being at 72 degrees. However, it will be appreciated that any number of informational values may be displayed.

In FIG. 5, the sensed temperature value 34 and the temperature set point value 36 are shown roughly in a center of the flexible display 32. This may correspond to the proximity sensor 24 determining that the user's eyes are at least roughly directly in front of the HVAC controller 28. In some embodiments, "directly" in front of the HVAC controller 28 may refer to a position that can vary from exactly in front of the HVAC controller 28 (a position in which the user's eyes likely transects a line extending perpendicularly from the center of the flexible display 32 of the HVAC controller 28) to a position in which the user is up to about 30 degrees, 20 degrees, 10 degrees or less, of either side of said perpendicular line.

In some embodiments, the display controller 22 is configured to display one or more display elements at a more rightward location on the flexible display 32 (when facing the flexible display 32) when the proximity sensor 24 senses a user at a more rightward position than when the proximity sensor 24 senses a user at a more leftward position relative to the flexible display 32. To illustrate, FIG. 6 shows the sensed temperature value 34 and the temperature set point value 36 displayed toward a left hand side of the flexible display 32, corresponding to the proximity sensor 24 determining that the user is on the left hand side (when facing the flexible display 32) of the HVAC controller 28. Similarly, FIG. 7 shows the sensed temperature value 34 and the temperature set point value 36 displayed toward a right hand side of the flexible display 32, corresponding to the proximity sensor 24 determining that the user is on the right hand side of the HVAC controller 28. In some embodiments, the display controller 22 adjusts the position of whatever is being displayed in real time or near real time with respect to a current sensed user position.

In some embodiments, the display controller 22 may be configured to display two or more display elements (such as the illustrated sensed temperature value 34 and the temperature set point value 36) with a particular positional relationship between the two or more display elements. Even if the display controller 22 moves where the two or more display elements are displayed, such as to the left side or to the right side, in some embodiments the positional relationship may be maintained. To illustrate, in FIGS. 5-7, the relative spacing and positioning between the sensed temperature value 34 and the temperature set point value 36 remain constant. As illustrated, the distance between the two displayed values remains constant, and the relative position (sensed temperature value 34 on the left, temperature set point value 36 on the right) remains constant. It will be appreciated that these spatial relationships may exist between any desired combinations of display elements.

Figure 8:
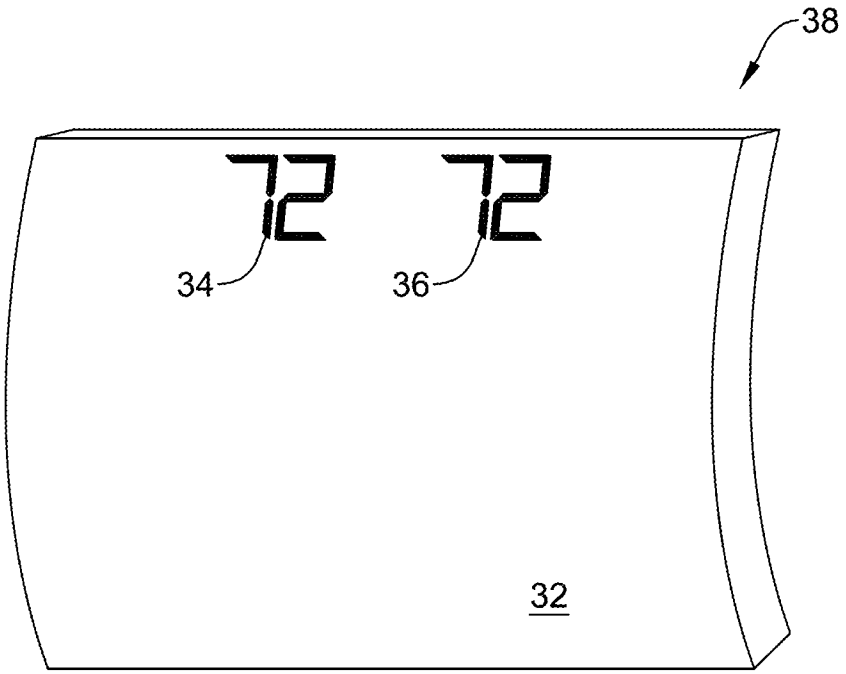
FIG. 8 is an illustration of a screen displayable on an illustrative HVAC controller.
Figure 9:
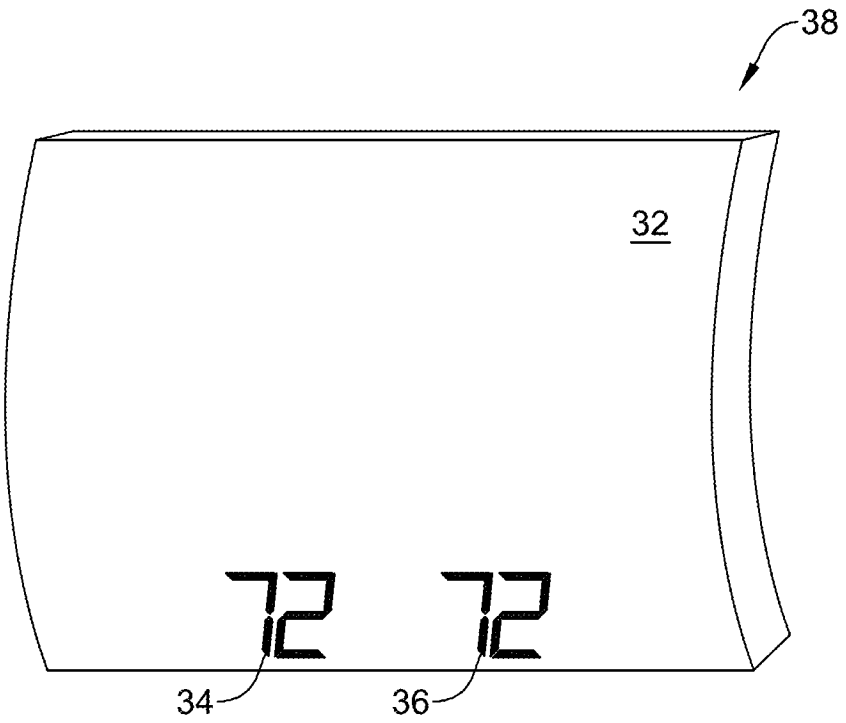
FIG. 9 is an illustration of a screen displayable on the HVAC controller of FIG. 8.

In FIGS. 4 through 7, the flexible display 32 is seen as curving from side to side, in a horizontal direction, with no or essentially no curvature up or down, in a vertical direction. In this, reference to horizontal and vertical merely refer to the illustrated orientation and are not intended to be limiting in any fashion. FIGS. 8 and 9 illustrate an HVAC controller 38 that curves in a vertical direction while not curving in a horizontal direction. An illustrative application of an HVAC controller 38 curved in this fashion may, for example, be an HVAC controller that is configured to fit into or onto the front edge of a built in shelving unit, or perhaps the curved edge of a bar. In another illustrative application, the HVAC controller 38 may be mounted on a flat wall, and may curve out into the space.

In FIG. 8, the sensed temperature value 34 and the temperature set point value 36 are displayed in an upper portion of the flexible display 32, corresponding to a situation in which the proximity sensor 24 detects a relatively tall user, and/or a situation in which the HVAC controller 38 is mounted at a vertical position that is lower than might commonly be expected. In FIG. 9, the sensed temperature value 34 and the temperature set point value 36 are displayed in a lower portion of the flexible display 32, corresponding to a situation in which the proximity sensor 24 detects a relatively shorter user, or a user in a chair or wheelchair, and/or a situation in which the HVAC controller 38 is mounted at a vertical position that is higher than might commonly be expected. In some cases, esthetic and/or other concerns may dictated a higher than usual or lower than usual mounting position for the HVAC controller 38.

Figure 10:
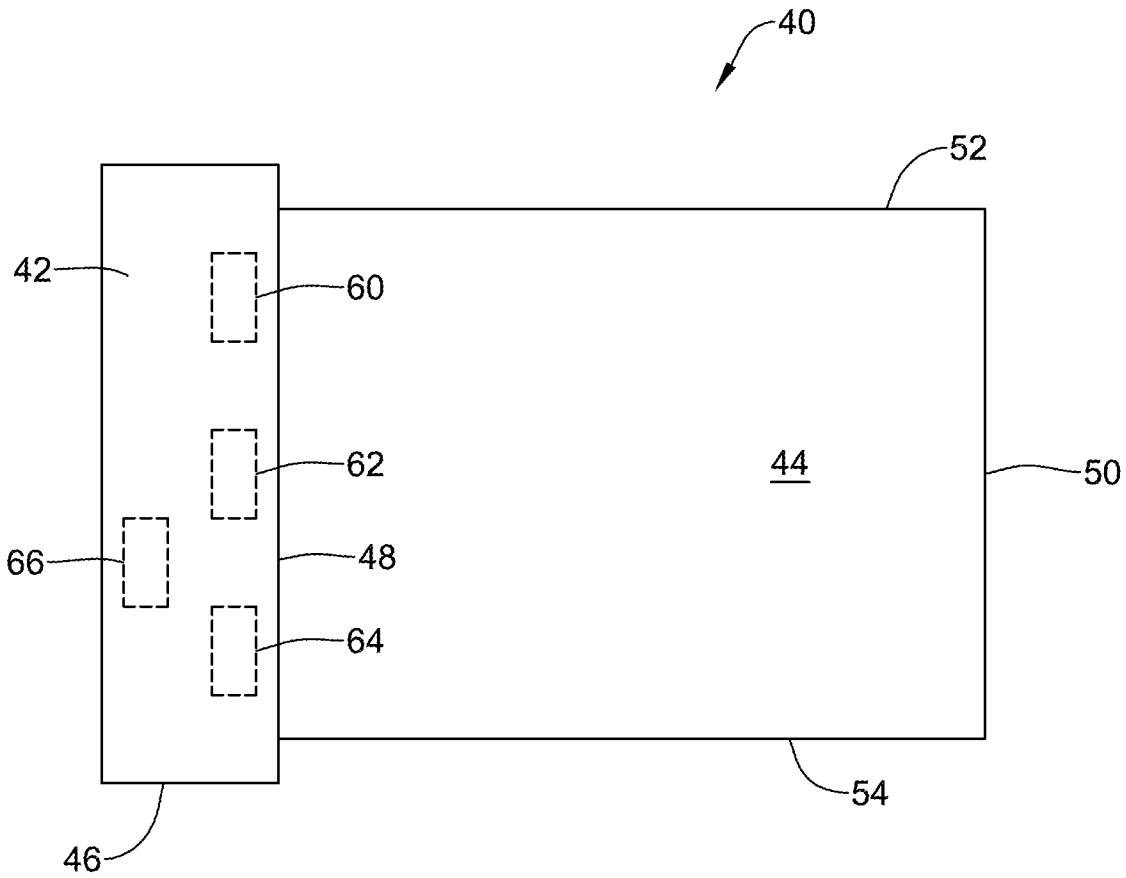
FIG. 10 is a schematic illustration of an illustrative HVAC controller.

FIG. 10 illustrates an HVAC controller 40 that includes a control module 42 and a flexible display 44. The control module 42 may include the electronic circuitry that forms much of the HVAC controller 40, apart from the flexible display 44. For example, the control module 42 may include a rigid housing 46 that houses one or more of a display controller 60 such as the display controller 22, a temperature sensor 62, a wireless interface 64 and a battery 66. In some embodiments, the control module 42 may be configured to accommodate and electrically connect to two or more control wires that extend to the HVAC system 12 and carry control signals from the HVAC controller 40 to the HVAC system 12.

Figure 11:
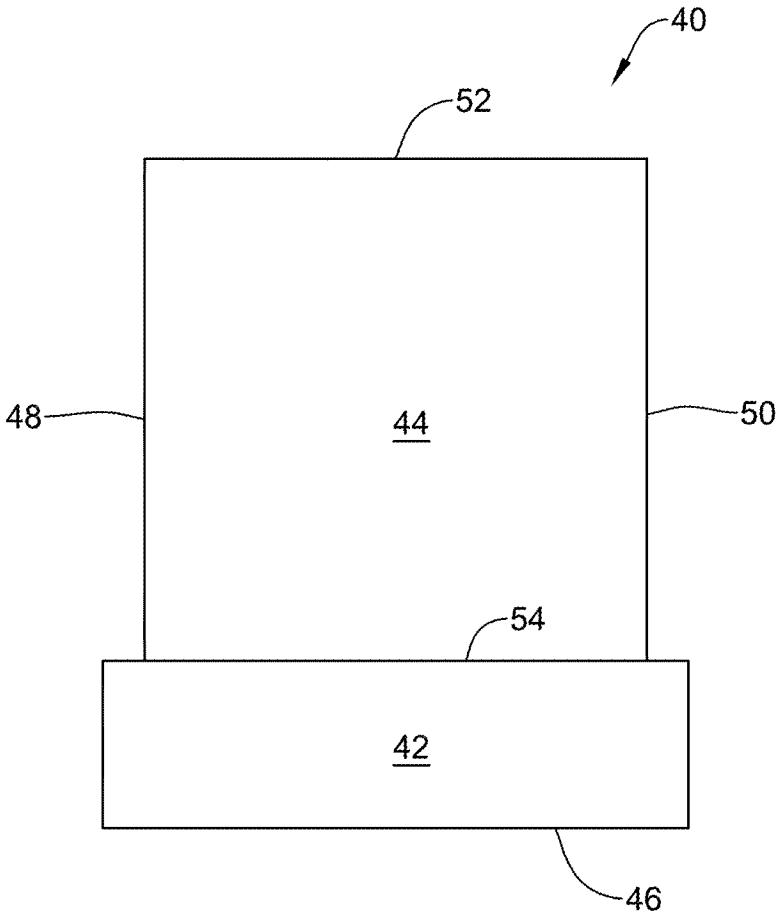
FIG. 11 is a schematic illustration of an illustrative HVAC controller.

In some embodiments, the flexible display 44 may be considered as being rectangular in shape, with a left edge 48, a right edge 50, a top edge 52 and a bottom edge 54. In some embodiments, as shown in FIG. 10, the control module 42 is positioned along the left edge 48 of the flexible display 44. In some cases, the control module 42 may be positioned along the right edge 50. In some embodiments, as shown in FIG. 11, the control module 42 may be positioned along the bottom edge 54. In some cases, the control module 42 may be positioned along the top edge 52.

Figure 12:
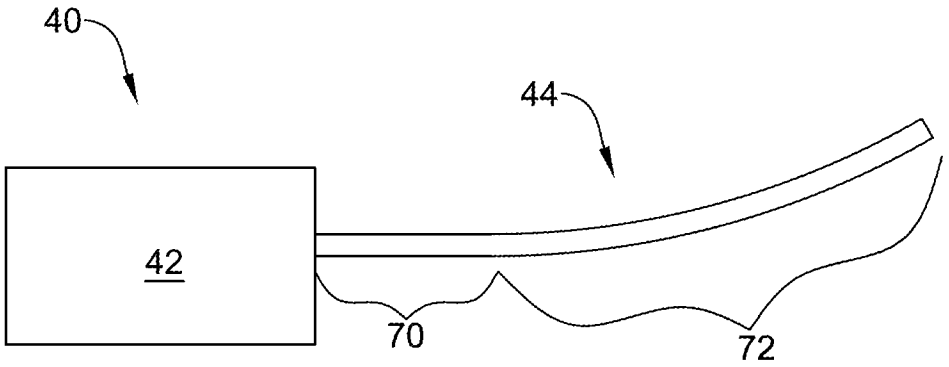
FIG. 12 is a schematic top illustration of an illustrative HVAC controller.

FIG. 12 is a top view of the HVAC controller 40 of FIG. 10, illustrating the relationship between the control module 42 and the flexible display 44. In some embodiments, the flexible display 44 may be considered as including a first profile 70 immediately adjacent the control module 42 and transitioning to a second, different, profile 72 away from the control module 42. In some embodiments, the first profile 70 is substantially planar while the second profile 72 is substantially non-planar. The second profile 72 may be considered as being concave or convex. In some embodiments, the second profile 72 may be factory-determined and created. In some embodiments, the second profile 72 may be formed in the field, to fit a desired mounting surface.

Figure 13:
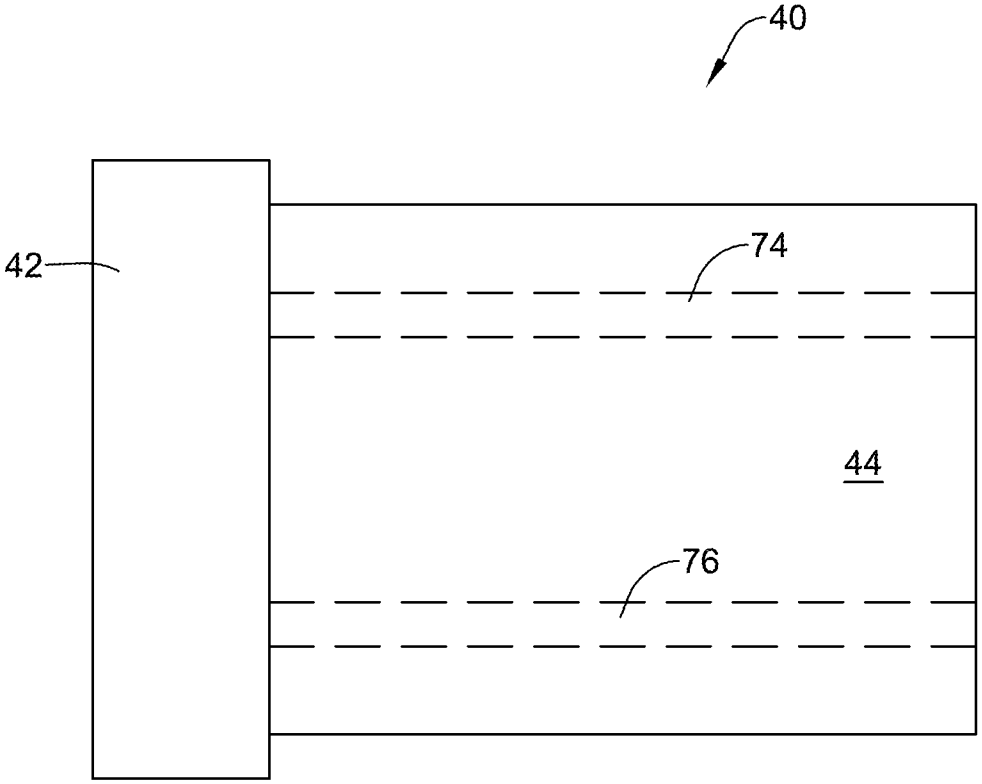
FIG. 13 is a schematic illustration of an illustrative HVAC controller.

In some embodiments, the flexible display 44 may be configured such that it can be curved into a desired shape and the flexible display 44 will retain the desired shape. In some embodiments, the flexible display 44 is too flexible, and cannot by itself retain a desired shape. In some embodiments, as shown in FIG. 13, the HVAC controller 40 may include a first shapeable bar 74 and a second shapeable bar 76, shown in phantom from the front of the HVAC controller 40. The shapeable bars 74, 76 may be formed of a metal or similar material that can be bent or curved into a desired shape and will retain the desired shape. The flexible display 44 may be secured to the shapeable bars 74, 76. While two shapeable bars 74, 76 are illustrated, it will be appreciated that any desired number may be employed.

Figure 14:
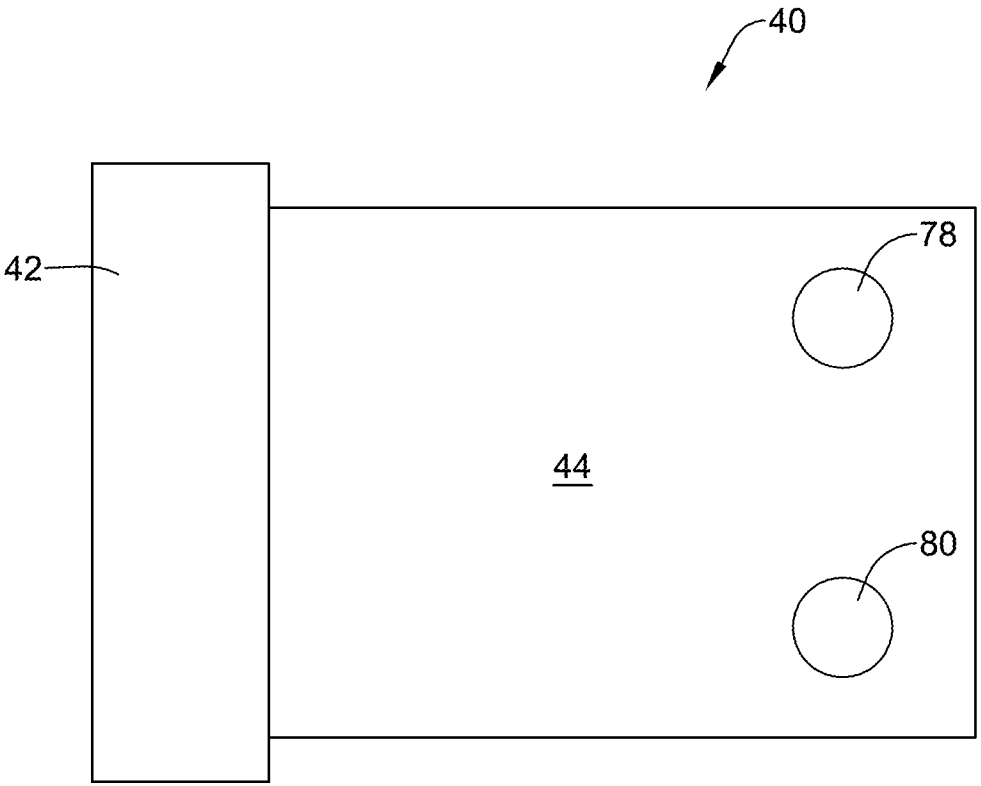
FIG. 14 is a schematic illustration of a back portion of an illustrative HVAC controller.

In some embodiments, as shown in FIG. 14, the HVAC controller 40 may include a first adhesive pad 78 and a second adhesive pad 80 that may be secured to the back of the flexible display 44 and then secured to a curved mounting shape in order to preserve a desired curvature of the flexible display 44. While two adhesive pads 78, 80 are illustrated, it will be appreciated that any desired number may be employed.

Figure 15:
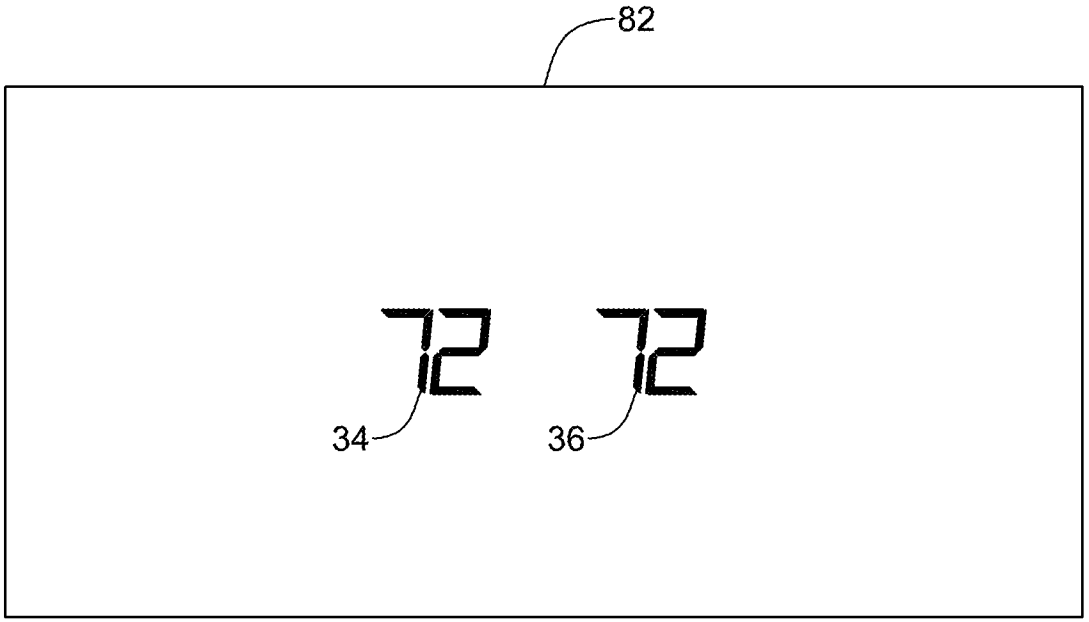
FIG. 15 is an illustration of a screen displayable on an HVAC controller.
Figure 16:
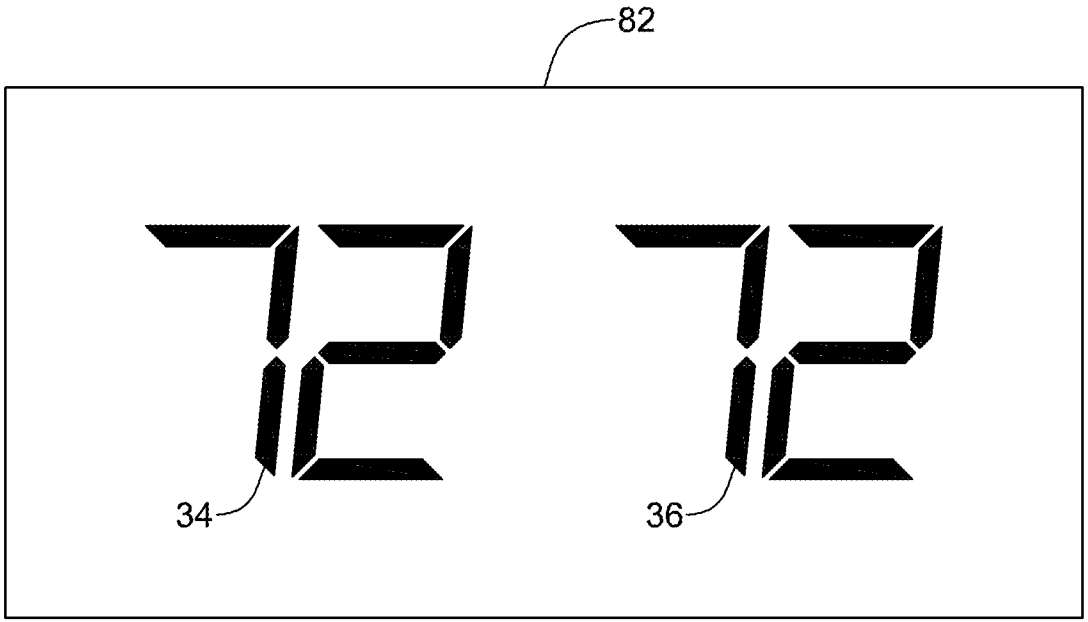
FIG. 16 is an illustration of a screen displayable on the HVAC controller of FIG. 15.

In some embodiments, with reference to FIG. 3, and as illustrated in FIGS. 5-9, the display controller 22 may display particular display elements in a particular position on the display 20 based upon where the proximity sensor 24 determines the user to be relative to the HVAC controller 14. In some embodiments, the displayer controller 22 may instead display one or more display elements in a different size, depending on user position. For example, FIG. 15 shows a display 82 displaying the sensed temperature value 34 and the temperature set point value 36 in a particular font size. In FIG. 16, however, the display 82 shows the sensed temperature value 34 and the temperature set point value 36 in a particular font size that is larger than that shown in FIG. 15. FIG. 16 corresponds to the user being detected at a relatively larger distance from the HVAC controller 14, so the display elements are displayed in a larger font for ease of reading.

It will be appreciated that features illustrated in distinct Figures may be combined into a particular HVAC controller. For example, any of the curved displays shown in FIGS. 4 through 9 and 15-16 may include a control module such as those shown in FIGS. 10 through 14, or may include the shapeable bars 74, 76 and/or adhesive pads 78, 80 shown in FIGS. 13 and 14.

It should be understood that this disclosure is, in many respects, only illustrative. Changes may be made in details, particularly in matters of shape, size, and arrangement of steps without exceeding the scope of the disclosure. This may include, to the extent that it is appropriate, the use of any of the features of one example embodiment in other example embodiments. The scope is, of course, defined in the language in which the appended claims are expressed.

What is claimed is:

1. A building controller for use in a building, comprising:

a flexible electronic display that can flex between a first configuration that may be planar or non-planar and a second configuration that is non-planar;

a display support for supporting the flexible electronic display, the display support configured to support the flexible electronic display in the first configuration that may be planar or non-planar and the second configuration that is non-planar, the display support enabling the flexible electronic display to be flexed from the first configuration to the second configuration in the building;

a proximity sensor for sensing a position of a user relative to the electronic display;

a controller configured to monitor one or conditions within the building and to send control signals to a building control system to control the one or more conditions within the building;

the controller is operatively coupled to the electronic display and the proximity sensor, and is configured to display two or more display elements on the electronic display, and wherein a location of the two or more of the display elements on the electronic display is based, at least in part, on the position of the user sensed by the proximity sensor relative to the electronic display, and the two or more display elements that are displayed on the electronic display include two or more building control parameters; and wherein a positional relationship between the two or more building control parameters is maintained regardless of whether the flexible electronic display is in the first configuration or the second configuration.

2. The building controller of claim 1, wherein the controller is configured to display an image on the electronic display that includes the two or more display elements, wherein the two or more display elements have a positional relationship in the image, and wherein the location of the image on the electronic display is based, at least in part, on the position of the user sensed by the proximity sensor, and wherein the positional relationship of the two or more display elements is maintained regardless of the location of the image on the electronic display, and wherein at least one of the two or more display elements is a building control parameter.

3. The building controller of claim 1, wherein the controller is configured to display the two or more of the display elements at a lower location on the electronic display when the proximity sensor senses a user at a lower position than when the proximity sensor senses a user at a higher position relative to the electronic display.

4. The building controller of claim 1, wherein the controller is configured to display the two or more of the display elements at a more rightward location on the electronic display when the proximity sensor senses a user at a more rightward position than when the proximity sensor senses a user at a more leftward position relative to the electronic display.

5. The building controller of claim 1, wherein the controller adjusts the position of the two or more of the display elements of the graphical user interface on the electronic display in real or near real time based on a current sensed position of the user.

6. The building controller of claim 1, wherein the sensed position comprises one or more of an up-down position of the user and a left-right position of the user relative to the electronic display.

7. The building controller of claim 1, wherein the proximity sensor comprises an IR proximity sensor.

8. The building controller of claim 1, wherein the proximity sensor comprises a CCD.

9. The building controller of claim 1, wherein the electronic display is a flexible LED display.

10. The building controller of claim 1, wherein the electronic display is a flexible AMOLED display.

11. The building controller of claim 1, wherein the electronic display is a flexible LCD display.

12. The building controller of claim 1, wherein the electronic display comprises a touch screen electronic display.

13. The building controller of claim 1, wherein the building controller is a Heating, Ventilation, and/or Air Conditioning (HVAC) controller and further comprises a temperature sensor operably coupled to the controller, and wherein one of the building control parameters that is displayed on the electronic display includes a temperature that is sensed by the temperature sensor.

14. A user interface for a building controller, comprising:

a electronic display that can be flexed between a first configuration that may be planar or non-planar and a second configuration that is non-planar;

a proximity sensor for detecting a user approaching the electronic display and for sensing a position of a user relative to the electronic display;

a controller operatively coupled to the electronic display and the proximity sensor, the controller configured to switch the electronic display from a sleep state to a wake up state in response to an approaching user, the controller configured to display two or more display elements on the electronic display, wherein at least one of the two or more display elements include a building control parameter, and wherein a size of the two or more of the display elements on the electronic display is based, at least in part, on the position of the user sensed by the proximity sensor; and wherein a directional relationship between the two or more display elements is maintained regardless of whether the flexible electronic display is in the first configuration or the second configuration.

15. The user interface of claim 14, wherein the controller is configured to display one or more of the display elements at a larger size on the electronic display when the proximity sensor senses a user at a position that is further away from the electronic display than when the proximity sensor senses a user at a closer position.

16. A user interface assembly for a Heating, Ventilation, and/or Air Conditioning (HVAC) Controller, comprising:

a flexible electronic display;

a control module mechanically coupled to the flexible electronic display such that the flexible electronic display extends laterally out past an outer lateral extent of the control module;

a controller disposed within the control module and operatively coupled to the flexible electronic display, the controller configured to display one or more HVAC control parameters on the flexible electronic display; and wherein the user interface assembly is configured to be flexed between a first configuration that may be planar or non-planar and a second configuration that is non-planar so that the flexible electronic display assumes a desired curved shape, wherein a spatial relationship between the two or more display elements is maintained regardless of whether the flexible electronic display is in the first configuration or the second configuration.

17. The user interface assembly of claim 16, further comprising a releasable adhesive element for releasably securing the user interface assembly to a mounting surface.

18. The user interface assembly of claim 16, further comprising one or more adjustable supports that can be adjusted in the field to change the shape of the flexible electronic display.

* * * * *